US006283267B1

(12) United States Patent
Tanaka

(10) Patent No.: US 6,283,267 B1
(45) Date of Patent: Sep. 4, 2001

(54) COIN SELECTOR ASSEMBLY

(75) Inventor: Yoshinobu Tanaka, Iwatsuki (JP)

(73) Assignee: Asahi Seiko Co., Ltd., Tokyo (JP)

( * ) Notice: Subject to any disclaimer, the term of this patent is extended or adjusted under 35 U.S.C. 154(b) by 0 days.

(21) Appl. No.: 09/415,172

(22) Filed: Oct. 8, 1999

(30) Foreign Application Priority Data

Oct. 9, 1998 (JP) ..... 10-324355
Sep. 3, 1999 (JP) ..... 11-249562

(51) Int. Cl.[7] ..... G07F 1/04
(52) U.S. Cl. ..... 194/334; 453/9
(58) Field of Search ..... 194/334, 335, 194/336, 337, 345; 453/9

(56) References Cited

U.S. PATENT DOCUMENTS 1,378,720 * 5/1921 Roeling et al. ..... 453/9
3,837,454 * 9/1974 Joeck ..... 194/344
4,544,058 * 10/1985 Choderker et al. ..... 194/334 X
5,293,981 3/1994 Abe et al. ..... 194/345

FOREIGN PATENT DOCUMENTS

0040963 * 9/1965 (DE) ..... 453/9
70737 * 9/1952 (NL) ..... 194/336

* cited by examiner

*Primary Examiner*—F. J. Bartuska
(74) *Attorney, Agent, or Firm*—Price and Gess

(57) ABSTRACT

A coin selector assembly includes a frame member having an upper entrance opening for receiving a coin and a plurality of coin ejection openings. A passageway extends through the frame member from the upper entrance opening to a plurality of ejection openings. The entrance passageway has an arcuation entrance portion to contact a peripheral surface of a coin and to change its direction through the frame member. A replaceable roller unit can assist in sorting the coins. The frame member has a vertical height approximating a horizontal length to facilitate a vertical mounting in a coin operated machine.

21 Claims, 13 Drawing Sheets

COIN SELECTOR ASSEMBLY

BACKGROUND OF THE INVENTION

1. Field of the Invention

The present invention is directed to a coin selector assembly that can be mounted in coin operated machines, such as vending machines, arcade game machines, casino game machines, and the like that receive coins and, more particularly, to a compact simplified coin selector mechanism that can be adjusted for different size coins.

2. Description of Related Art

Vending machines, arcade games, and other devices that are operated by the insertion of one or more coins generally mount a coin slot that is connected to a mechanical or electromechanical coin selector mechanism to determine the genuineness of the coin and to count the coins that are inserted into the machine. The term "coin"can refer to monetary coins usually of a disk-shaped configuration and also to other disk-shaped medallions, tokens, etc., which can be used in games, entry turnstiles, vending machines, and the like. For example, a coin selector mechanism is frequently used in Pachinko and other games, such as a pinball-style slot machine. Various types of selector mechanisms have been developed in this industry, such as U.S. Pat. No. 5,293,981. Another example of prior art can be found in the Japanese Utility Model Application No. 23240/1992.

Reference can be made to FIG. 7 which shows diagrammatically a selector mechanism for coins of Laid-Open Japanese Utility Model Application No. 25963/1994. FIG. 7(A) represent a diagrammatic perspective view of a coin selector from an upper left hand perspective view. FIG. 7(B) represents a diagrammatic cross-sectional view of a portion of the coin selector. The coin selector has a main body frame 4 of an elongated configuration. Installation tabs or wings 19 or 18 are formed at each end of the main body frame for appropriate connection within the body of a coin receiving machine. When installed, the main body frame 4 is positioned in an inclined horizontal manner and is held in a fixed position in the interior of the game machine. Thus, the direction of the length and the direction of the width are inclined relative to a horizontal plane to thereby permit a desired orientation of the coin as it passes through the coin selecting mechanism downstream from the entrance slot 1. The frame is elongated in the horizontal direction.

As the coin enters the coin sorting device, it passes through a sorting passageway which is capable of separating various coins into an acceptable and a non-acceptable category. A rectangular window 9 is opened along the passageway at a central lower part of the main body frame 4. A coin guide flange 10 of a thin elongated rectangular configuration is fixed on the upper edge of the window 9. As shown in FIGS. 7(A) and 7(B), a small bent board arm 11 is rotatably installed about a pivot point 8 that is positioned above the coin guide 10. As a result of this pivotal mounting, the lower half of the board arm 11 can be inserted into and out of the window 9 for the purpose of ejecting a coin. An extended door member 5 is also installed rotatably at the pivot position 8 in the upper part of the main body frame and can be spring-biased by a spring, not shown. Both the door board 5 and the board arm 11 can be integrately rotatable about the pivot 8 and against the spring force. As a result, the board arm 11 will be moved only by moving the door board 5.

The top portion of the main body frame 4 and the door board 5 is bent to form the coin entrance 1. Downstream from the rectangular window 9 is a cover board 7 that can support a cylindrically shaped solenoid 16. Mounted on the solenoid 16 is a lid plate 5 having a bent L-shape which is pivotable about the portions 14 at the upper portion. By action of the solenoid 16, a coin fall hole 12 of a long and slender shape can be opened and shut. On the right hand side of FIG. 7(A) is a lid 13 which composes a portion of the cover board 17. A coin exit of a long and slender configuration is formed between this lid 13 and the main body frame 4.

When a coin is inserted into the entrance 1, it will roll on the rail 7 positioned at the lower edge of the main body frame 4. If the coin A, as shown schematically in FIG. 7(B), is genuine, the rolling of a coin will continue along the rail 7, as it is guided by the coin guide 10 and the door board 5. If the coin rolling down the rail 7 is not genuine and the diameter of the coin is smaller than regulation size, the coin will come off of the coin guide 10 or the door board 5 and will fall before it reaches the coin exit 2.

Conversely, if the coin rolling along the rail 7 is not genuine and has a diameter which is unduly large, the coin will be stopped by, for example, by a plate 110 which is mounted on the coin guide 10. In this case, if the door board 5 is moved against the resistance of the spring (not shown), the board arm 11 will also be moved and will contact the coin that is stopped by the plate 101 so that it will fall down and be ejected.

A coin selector assembly of this type, however, requires a fairly large mounting space in the horizontal direction of the game or vending machine. This increases the necessary installation space, especially since the entire coin selector has to be arranged to be inclined for the installation. As can be expected, when the machine is altered to accept a different size coin, the coin selector assembly also must be changed and accordingly it creates a problem in field maintenance and service of installed machines.

The prior art is accordingly still looking for improvements in coin selector devices.

SUMMARY OF THE INVENTION

The present invention is directed to a coin selector assembly having a frame member with an upper entrance opening for receiving a coin. A passageway extends through the frame member from the upper entrance opening and communicates with ejection openings for both delivering authentic coins and removing non-genuine coins. The passageway has an initial arcuation entrance portion to direct the coin from a vertical drop to an inclined horizontal direction to contact the sorting portion of the passageway.

Mounted in the passageway is a roller unit that can limit the size of coins traveling through the passageway. The roller unit can be positively driven to accelerate the coin and can further stop a coin for permitting ejection of oversized coins. The roller unit can be replaced by a service technician to alter the size of the coins to be selected by the coin selector assembly. The roller unit can comprise a first and second roller member or alternatively a unitary roller member with an appropriate groove to present an inverted V cross-section at the upper part of the passageway. The roller unit can further be spring biased in a traverse direction to that of the axis of the passageway to dampen vibration of fed coins.

The outside envelope of the coin selector assembly frame member is designed for vertical mounting within a coin receiving machine. The frame member has a vertical height of approximately the dimension of a horizontal length and facilitates the removal and servicing of the coin selector assembly, including changing the dimension of the roller unit.

BRIEF DESCRIPTION OF THE DRAWINGS

The objects and features of the present invention, which arc believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the general principles of the present invention have been defined herein specifically to provide a compact coin selector assembly that can be easily installed and adjusted for different size coins.

The coin selector of the present invention was developed for the purpose of providing a more compact size to a coin selector assembly and to enable it to be installed in an appropriate coin-operated machine so that the frame of the coin selector is orientated in a vertical direction rather than in an inclined horizontal position. The present invention was further developed for the purpose of enabling a field technician or service man to easily change the desired diameter size of a coin to be selected. Finally, the present invention was designed to provide a positive movement of a coin in a coin selector device and to improve its functionality.

Figure 1:
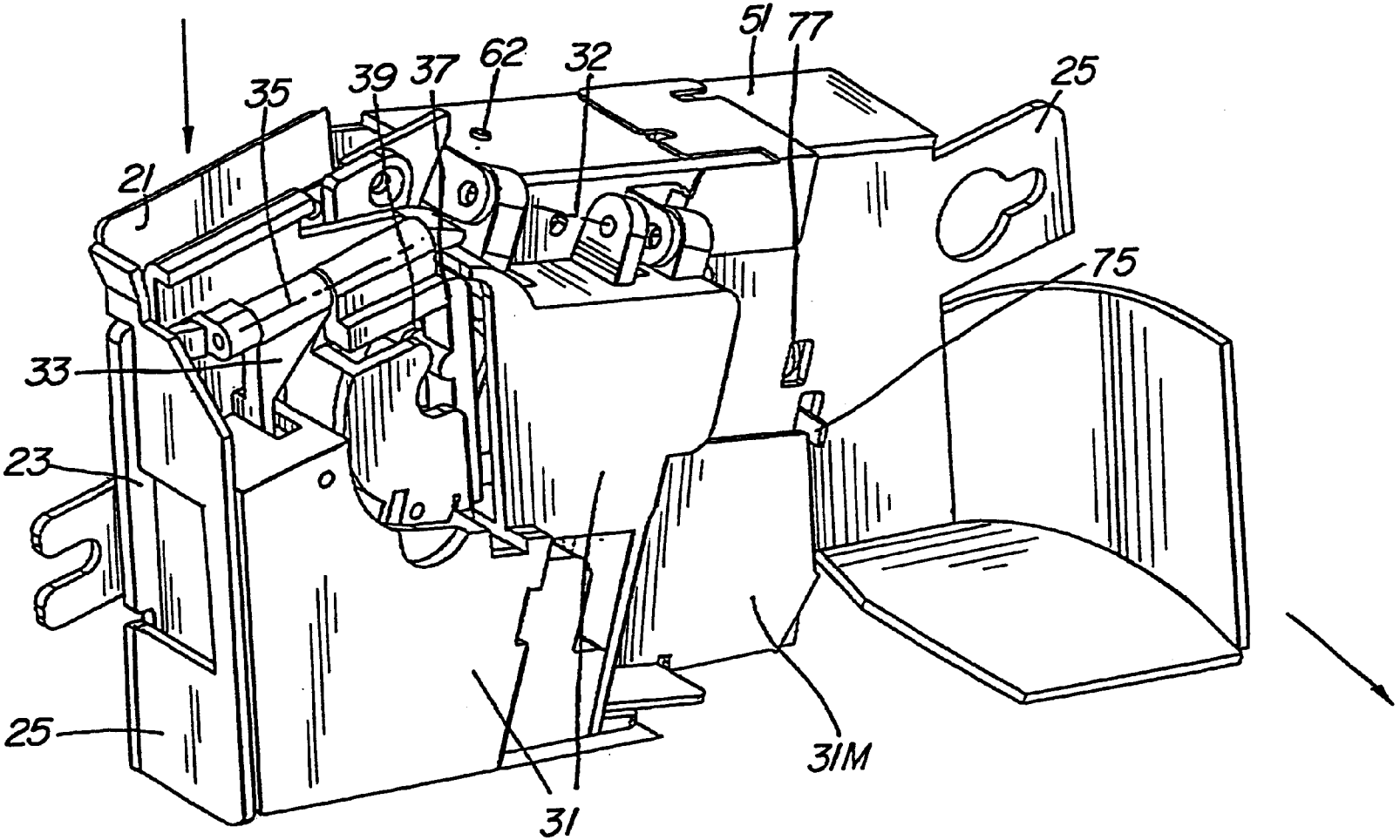
FIG. 1 is a perspective view of a first embodiment of the present invention.
Figure 6:
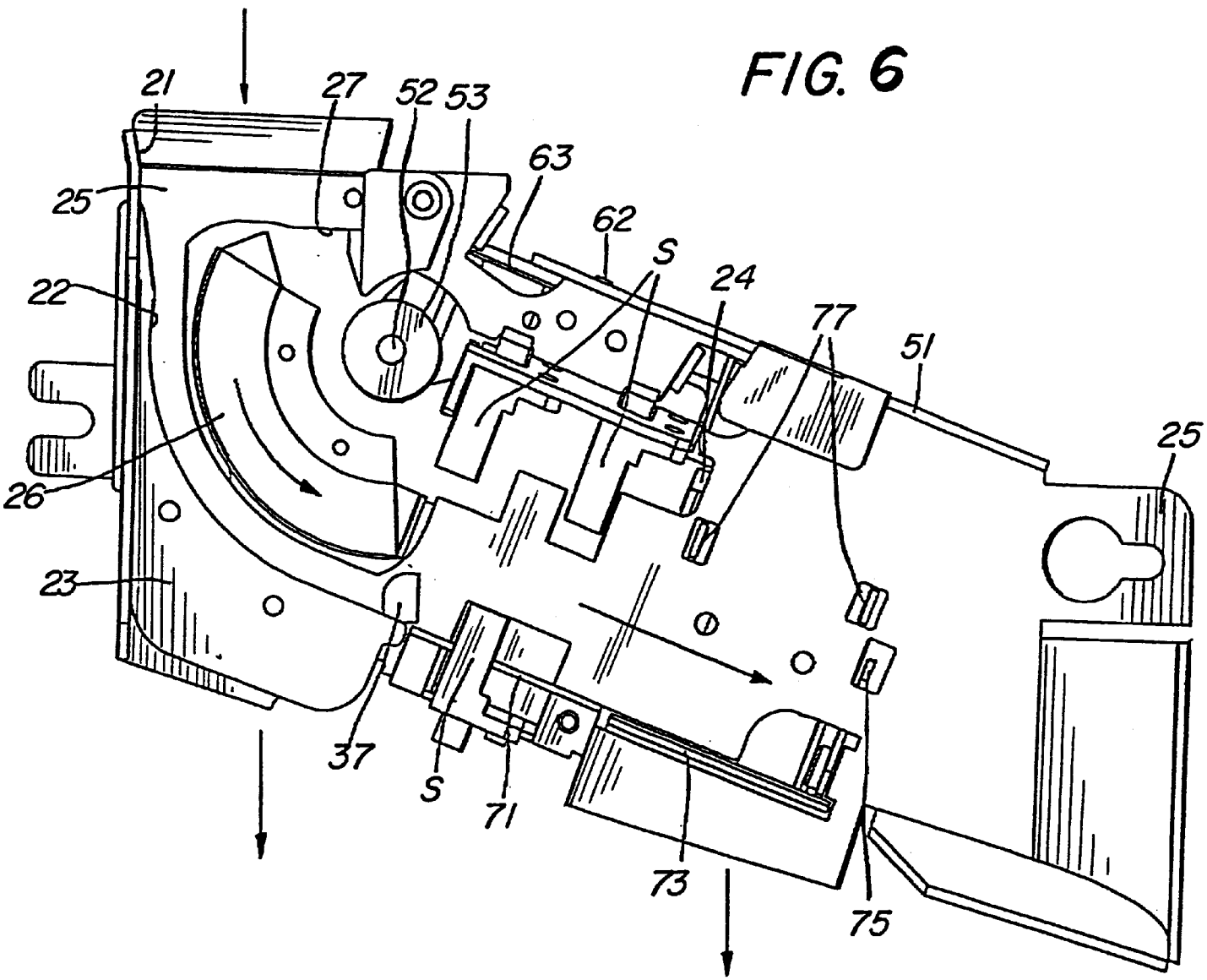
FIG. 6 is a front view of FIG. 2 with a portion of the components removed.
Figure 7A:
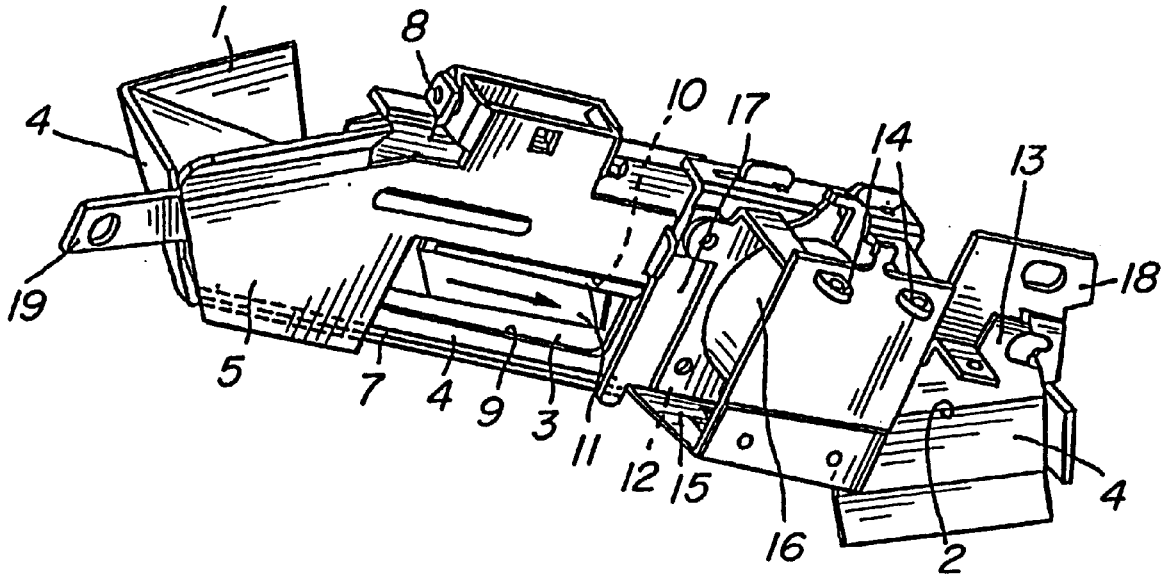
FIG. 7A PRIOR ART
FIG. 7(A) is a perspective view of a prior art embodiment.
Figure 7B:
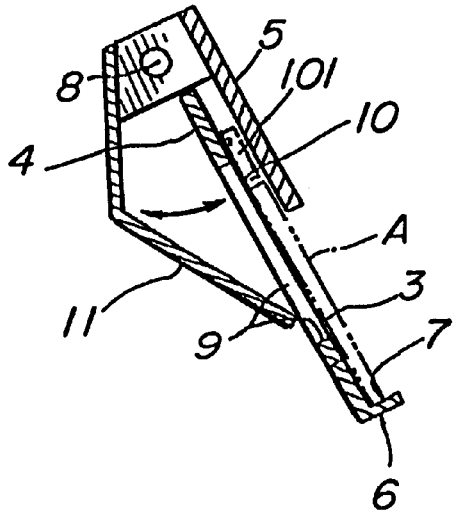
FIG. 7B PRIOR ART
FIG. 7(B) is a partial cross-sectional view of the prior art.

Referring to FIGS. 1 and 6, the arrow above the open mouth of the coin selector of the present invention indicates the direction in which a coin is usually inserted. As can be determined, when the coin is dropped or thrown into the entrance mouth 21, it will be shortly turned, by an arcuation entrance portion, at an acute angle which is guided by a circular arc passageway 22 through approximately one quarter of a circle before it is delivered to a sorting portion of the passageway 22. The circular arc portion of the passageway 22 is formed upon an upward peripheral surface of a somewhat thick board member 23 having a curved configuration. This curved board 23 is fixed to the main frame body 25.

Figure 5:
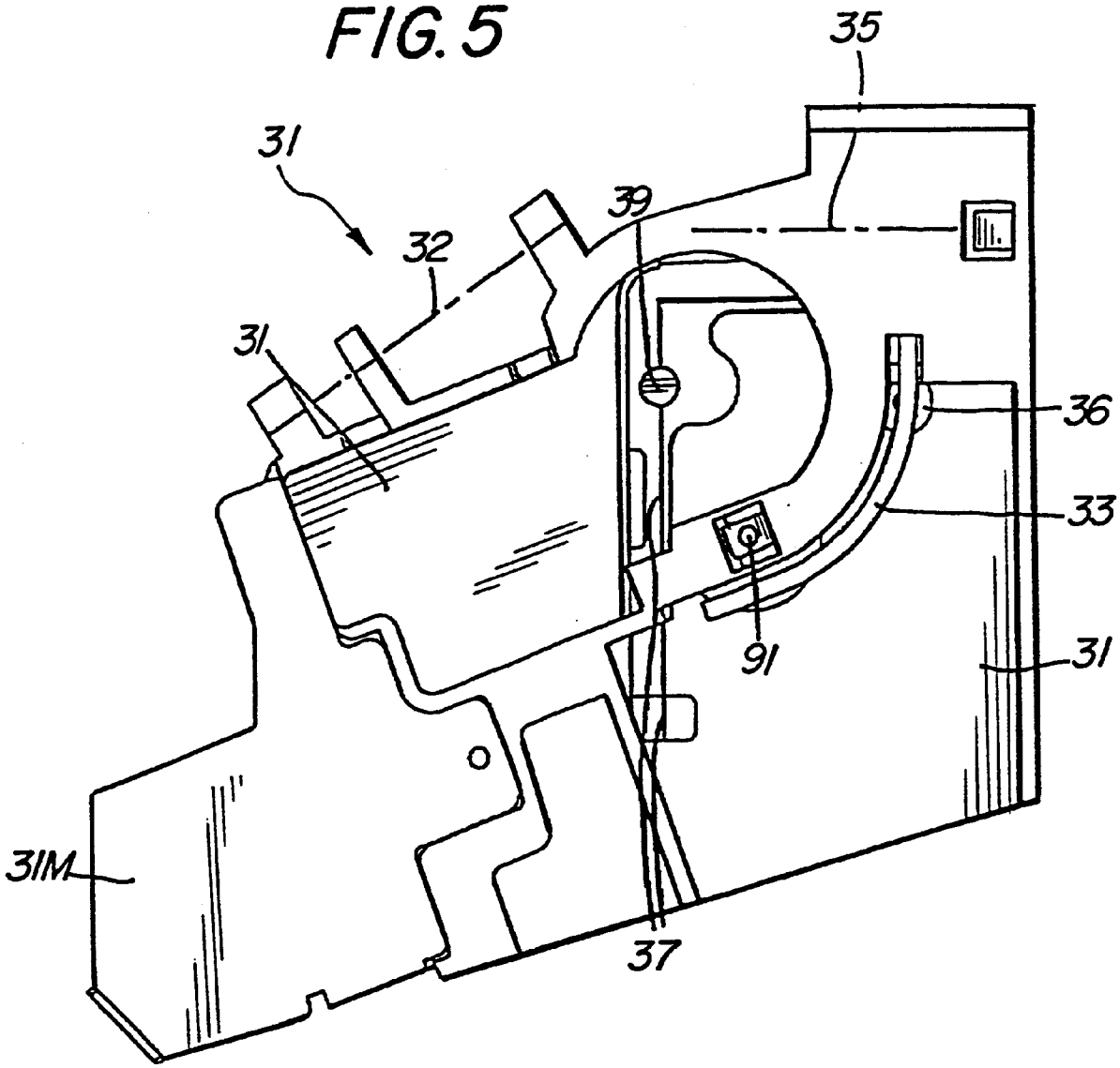
FIG. 5 is a partial view of FIG. 4.

The view in FIG. 6 discloses the coin selector without a cover plate or cover door 31 that extends across the curved board 23. The cover door 31, as seen in FIG. 5, can be formed of a generally pentagonal resin molded part and has an L-shaped metal plate 31M. This door 31 is swingably mounted on the main body frame 25 by means of a pivot 32 along its center top portion. The pivot axis is disclosed in the dotted line shown in FIG. 5.

Figure 4:
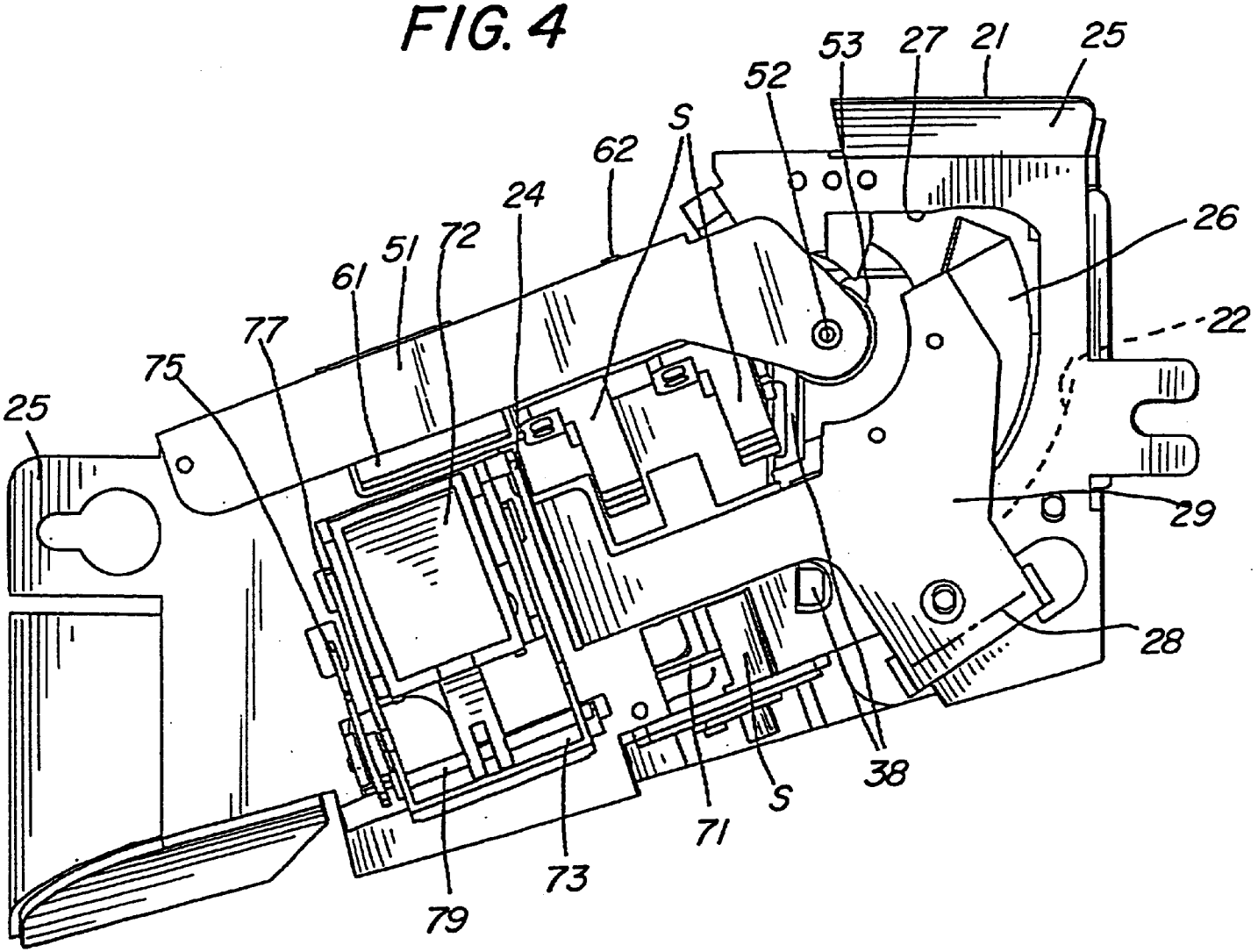
FIG. 4 is a rear view of the first embodiment.

A somewhat large C-shaped window or aperture 27 is open near the top of the main body frame 25, as can be seen in FIG. 6. A crescent-shaped swing plate 26 is provided along the edge of the window or aperture 27 near the arcuate passageway 22 and it is pivoted about an axis or a shaft along the axis 28 via a generally Y-shaped arm plate 29, as shown in FIG. 4. The function of the swing plate 26 and the arm plate 29 are to help remove a stuck coin from the passageway 22, as will be subsequently disclosed herein.

Figure 3:
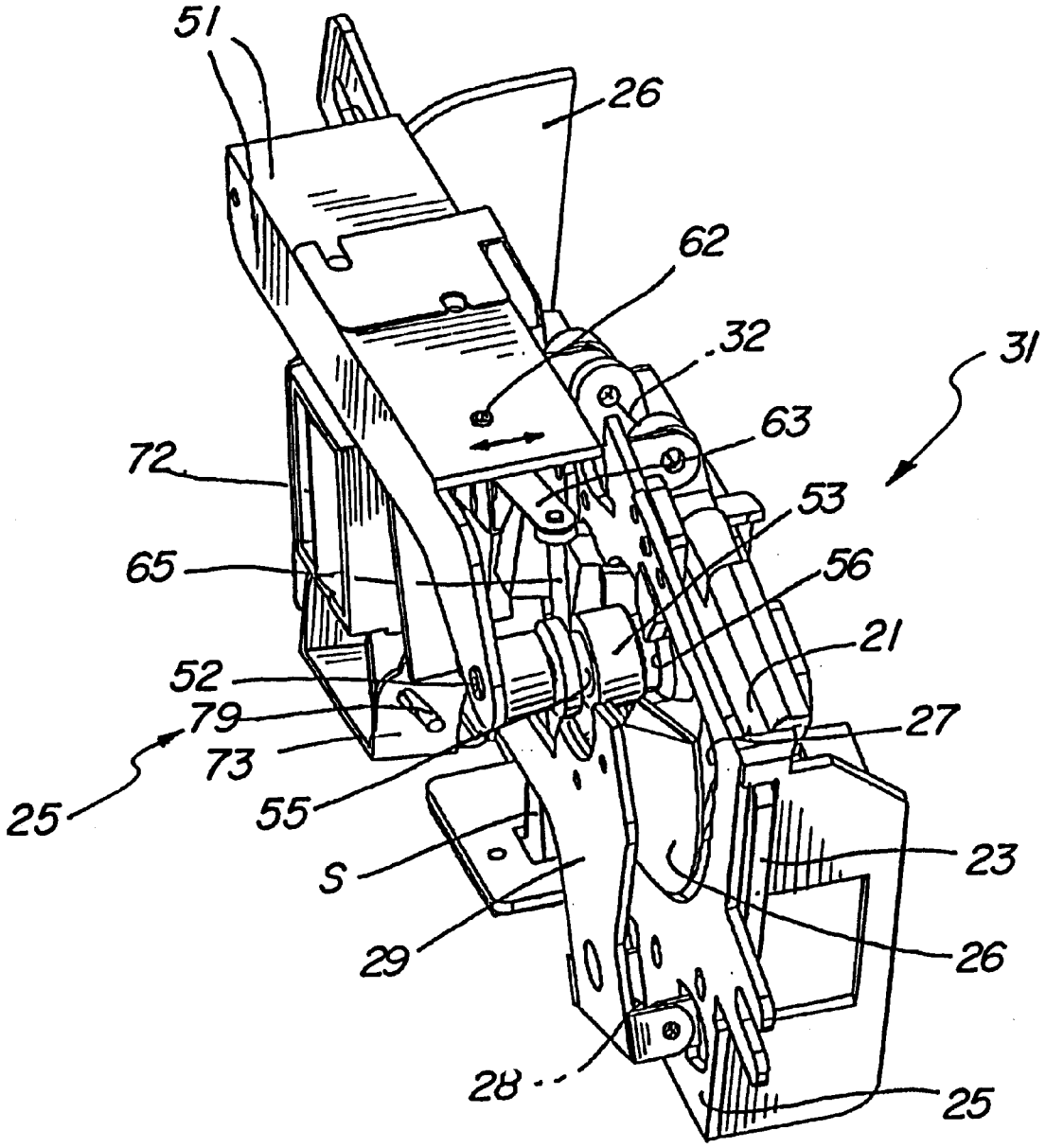
FIG. 3 is a partial diagrammatic perspective view of the first embodiment.

As seen in FIG. 4, an activator plate 24 can open or close the door 31 that is formed in the long end portion of the arm plate 29. This activator plate penetrates through the main body frame 25. The elongated arm 51 is formed outwardly in the center of the top edge of the main body frame 25 and is fixed at its distal end portion to a projecting shaft 52. The arm 51 is bent downward from its distal end portion. This projecting shaft 52 projects towards the door 31 and has a roller unit 53 that is rotatably fitted across the projecting shaft 52 via a spacer, not shown. The roller unit 53, as seen in FIG. 3, has a groove formed along its entire periphery adjacent its basal end portion. The groove 55 assists the roller unit 53 in sliding along the projecting shaft 52. The roller unit 53 also has a groove 56 formed along the entire periphery of the distal end portion, and this groove 56 guides the upper edge of an inserted rolling coin. One of the side faces of the groove 56 is appropriately inclined. Thus, the groove 46 in the roller unit 53 has a generally V-shaped cross-section. When a coin is inserted, in FIG. 3, in the opening mouth 21, it will descend downward and will be turned to come into contact with the groove 56 that is aligned in the passageway 22. A coin having a larger non-complying dimension will be stopped by interference with the height of the groove 56 positioned in the passageway 22.

Referring to FIG. 5, an urging member 33 is pivotably mounted to penetrate the door 31 and to exert a force against a passing coin so that it is biased towards the main body frame 25. A small spring 36, shown in FIG. 5, is provided between the door 31 and the urging member 33. The door 31 further includes a stopper 37 of an inverted L-shape that is suspended from the pivot 35, shown by the axis line on the left hand side of FIG. 5. The lower end portion of the stopper 37 can prevent further movement of a coin from falling down the arcuate passageway 22. Referring to FIG. 6, the stopper 37 is shown blocking the end of the passageway between the arcuate board member 22 and the swing plate 26.

Referring to FIG. 4, a small rectangular member, as shown in the top left side portion of FIG. 4, represent a partial view of the solenoid 61 that is mounted within the arm 51. A plunger, not shown, is connected to the solenoid 61 and has a small prolat link (not shown) that in turn is pivoted to an L-shape link (not shown). By reference to FIG. 3, the L-shaped link has a long spring element 63 that is pivoted about a post 62. A relatively long rod 65 is fixed to the underside of the distal end portion of the spring element 63. The tip of the rod 65 is slidably inserted into a groove 56 in the roller 53.

Figure 2:
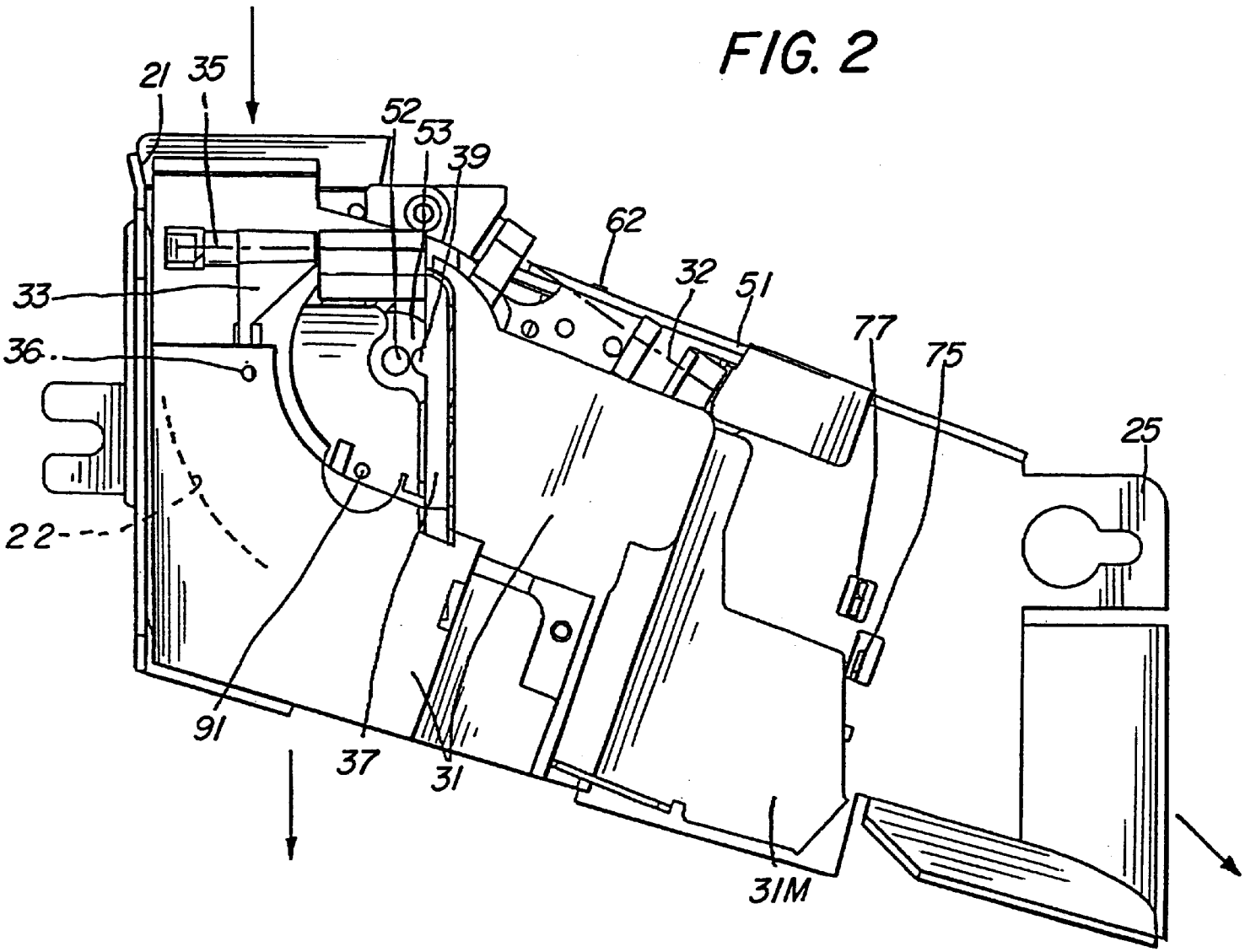
FIG. 2 is a front view of FIG. 1.

As a result of this arrangement, when the solenoid 61 is turned on, the spring element 63 can pivot about 62. This pivotal movement causes the rod 65 to move and causes further the roller unit 53 to approach the door 31, as indicated by the two-headed arrow in FIG. 3. Thus, the coin guiding groove 56 and the roller 53 unit are then placed into correspondence with the arcuate passageway 22. When the roller unit 53 approaches the door 31, it pushes the projecting part 39 of the stopper 37, as shown in FIG. 2. The projecting part or bump 39 is adjacent the projecting shaft 52. As a result of this pushing movement of the roller unit 53, the lower end portion of the stopper 37 is retracted and the coin falling down the arcuate passageway 22 will continue to roll down the arcuate passageway 22 adjacent to the fixed rail 71 in the main body frame 25.

Referring to FIG. 4, three counting sensors S are provided near the fixed rail 61. As a result of the passage of the coin along the rail 71, these sensors S can detect the movement of the coin. The sensors S can be any of a conventional configuration, including magnetic and optical sensors. It is preferred that at least three sensors S be utilized to ensure a tamper-proof operation of a coin selector.

Referring to the left side of FIG. 4, a second solenoid 72 is disclosed. The plunger of the solenoid 72 has a U-shaped movable rail 73 that is pivotably mounted on a shaft 79. Thus, each upper end portion of the U-shaped movable rail 73 is pivoted to the main body frame 25 at 77.

Referring to FIG. 3, a pair of inclined holes are open in the center of the movable rail 73 so that a shaft 79 can pass through them. The vertical side of the solenoid 72 mounted within its housing is also shown in FIG. 3. The movable rail 73 also includes a stopper 75 formed on the rail 73 via an arm extension. When the solenoid 72 is in an off state, the movable rail 73 is located outside the main body frame 25. The stopper 75, however, is located inside the main body frame 25. With the solenoid in the off state, a coin running down the fixed rail 71 is blocked by the stopper 75 and can drop into a safe storage container (not shown). If the solenoid 72 is activated, however, the movable rail 73 is located inside the main body frame 25 and the stopper 75 is located outside the main body frame 25. With the solenoid 72 on, the coin will move down the movable rail 73 and will be subsequently guided by the main body frame 25 to drop, as shown by the arrow in FIG. 1, so that it can be accommodated in, for example, a coin hopper tank (not shown) that is in alignment with the exit passageway.

It is possible to adjust the coin passageway to accommodate various size coins. Referring to FIG. 5, a small steel ball 91 is rotatably mounted and is adapted to be capable of approaching the main body frame 25. Briefly, the steel ball 91 serves to adjust the width of the arcuate passageway 22 in accordance with the desired thickness of the coin to be deposited in the slot 21. Thus, as can be appreciated, a technician can adjust the width of the passageway.

In operation, both of the solenoids 61 and 72 are usually activated to be in an on state and therefore the groove 56 and the roller unit 53 correspond to the position of the arcuate passageway 22. The movable rail 73 is located inside the main body frame 25. Needless to say, the stopper piece 37 is located outside the door 31, while the second stopper 75 is located outside the main body frame 25. When a coin C is thrown into the open aperture or mouth 21 in this state, the coin C will be guided and turned along the arcuation entrance portion of the circular arc passageway 22. When the coin C is genuine or when it is a desired or selected coin for operation of the machine, the circular arc passageway 22 will be passed with the lower edge of the coin C guided by the circular arc passageway 22 and the upper edge of the coin C guided by the groove 56 in the roller unit 53. Therefore, the genuine coin or the coin of the appropriate denomination will smoothly pass through the circular arc passageway and will further be turned in a downward direction. Since the rotation of the roller unit 53 is free in this case, a genuine coin will pass smoothly and speedily. As can be appreciated, it is desirable that the spring force exerted by spring 36 has a relatively weak power.

Figure 14:
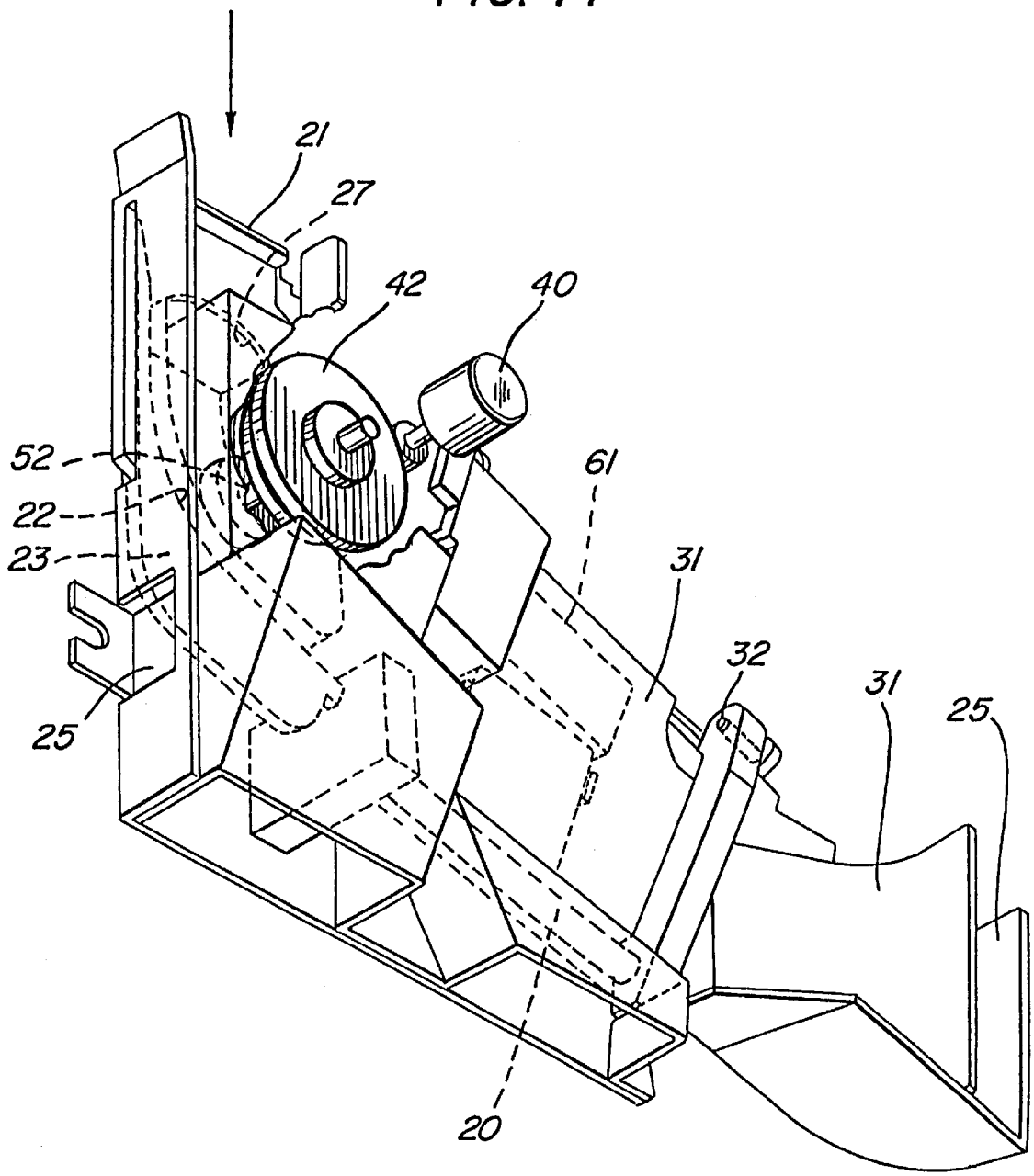
FIG. 14 is a partial perspective view of a third embodiment of the present invention.

As a modification, the roller unit 53 may be positively rotated by means of a small electric motor 40 shown in FIG. 14. In this embodiment, it is necessary that the pivot 52 may be formed for free rotation. Additionally, when the roller unit 53 is positively rotated, it is possible to accelerate the speed of the coin C through contact with the roller. The roller Unit 53 can constitute a single roller member 42.

If a counterfeit coin or a coin of the wrong denomination is thrown into the open mouth 21 of the coin selector and the diameter of the coin is small, the circular arc passageway will not pass such a coin. The lower edge of a small diameter coin will be guided by the circular arc passageway 22, but the upper edge of the concerned coin will not be guided by the groove 56. As a result, such a small diameter sized coin may be inclined as it falls down inside the door 31 and will be eventually removed from the passageway. It is possible when a small diameter coin is vibrating that the apparent diameter of the coin appears to be larger and to act like a genuine coin. The provision of the spring 36, however, will act to absorb the vibration of such a small size coin. As a result, when the coin comes off from the groove 56 in the roller unit 53, it will also be eliminated from the passageway 22.

If a coin which is thrown into the open mouth 21 is not genuine or is of a larger size denomination than the desired coin, then the diameter of such a coin will be larger than the expected or calibrated size and such a coin will not pass through the circular arc passageway 22. The lower edge of the coin will be guided along the circular arc passageway, but the upper edge of the coin will contact the roller unit 53. Accordingly, when the diameter of the coin is larger than the expected size, the coin cannot be moved by being placed between the circular arc passageway 22 and the roller 53. In this case, the arm plate 29 is opened and closed about the pivot 28 whereupon the large diameter coin will simply fall and be cancelled. The arm plate 29 will transmit the corresponding movement to the swing plate 26, while at the same time the door 31 will be opened or closed via the activator 24.

In the above embodiment, the roller unit 53 has a groove 56 and a generally V-shaped cross-section. As seen from the arcuate passageway 22, the groove 56 has a cross-section of an inverted V-shape. As an alternative embodiment of the present invention, the groove 56 can be further defined by a pair of separate rollers, see FIG. 12.

Additionally, the groove 56 can be formed on other members, for instance, on a semi-circular plate. In the cross-sectional shape of the groove 56, one slope will be accurately formed but it is, of course, possible to have two slopes formed. In the present embodiment, if it is necessary to change the size of a coin to be accepted by the coin selector, then a technician can simply replace the roller unit 53 with an appropriate size roller unit to meet the diameter of the coin to be sorted. Additionally, if the thickness of the coin to be sorted has to be changed, it is also possible to replace the roller unit 53.

As described above, a selector of the coin turning type is usually operated with both solenoids 61 and 72 turned on. This is not necessarily the only manner in which the present invention can be implemented. For example, the coin selector can be operated with solenoid 61 turned on, but solenoid 72 turned off. For example, both solenoids 61 and 72 are first turned on and coin sorting is performed until the first storage container or safe (not shown) is completely filled with coins, then solenoid 72 can be turned off and the coin sorting can still be performed until a second safe or container (not shown) is then filled up with coins.

The solenoid 61 is normally turned on but it may be turned off if trouble occurs in a machine utilizing the coin selector of the present type. In such an abnormal situation, then every coin that is dropped into the slot or mouth 21 will be cancelled, even if it is genuine. In addition, the position of the solenoid 21 is brought closer to the roller unit 53 and the mechanism for activating the rod 65 is altered. Therefore, not only the solenoid 72 but also the main body frame 25, arm 51, and metal plate 31M are removed. Although not shown, this design change can contribute to almost half of the overall size of the coin selector according to the embodiment that is shown in FIGS. 2 and 4 herein.

The advantages of the present invention can be realized in that the size of the entire coin selector can be reduced with a simple construction. Further, the invention adopts a passageway of a circular arc shape and the size of the coins that can be selected by the coin selector can be changed easily only by changing rollers that are used as a coin guide. As can be appreciated, the coin selector of the present invention can be vertically installed and can be easily accessed by a service technician. The coin guide roller used in the present invention is adapted to be movable and this offers a significant advantage in the coin sorting that can be effected at an early stage in the admission of the coins.

Figure 8:
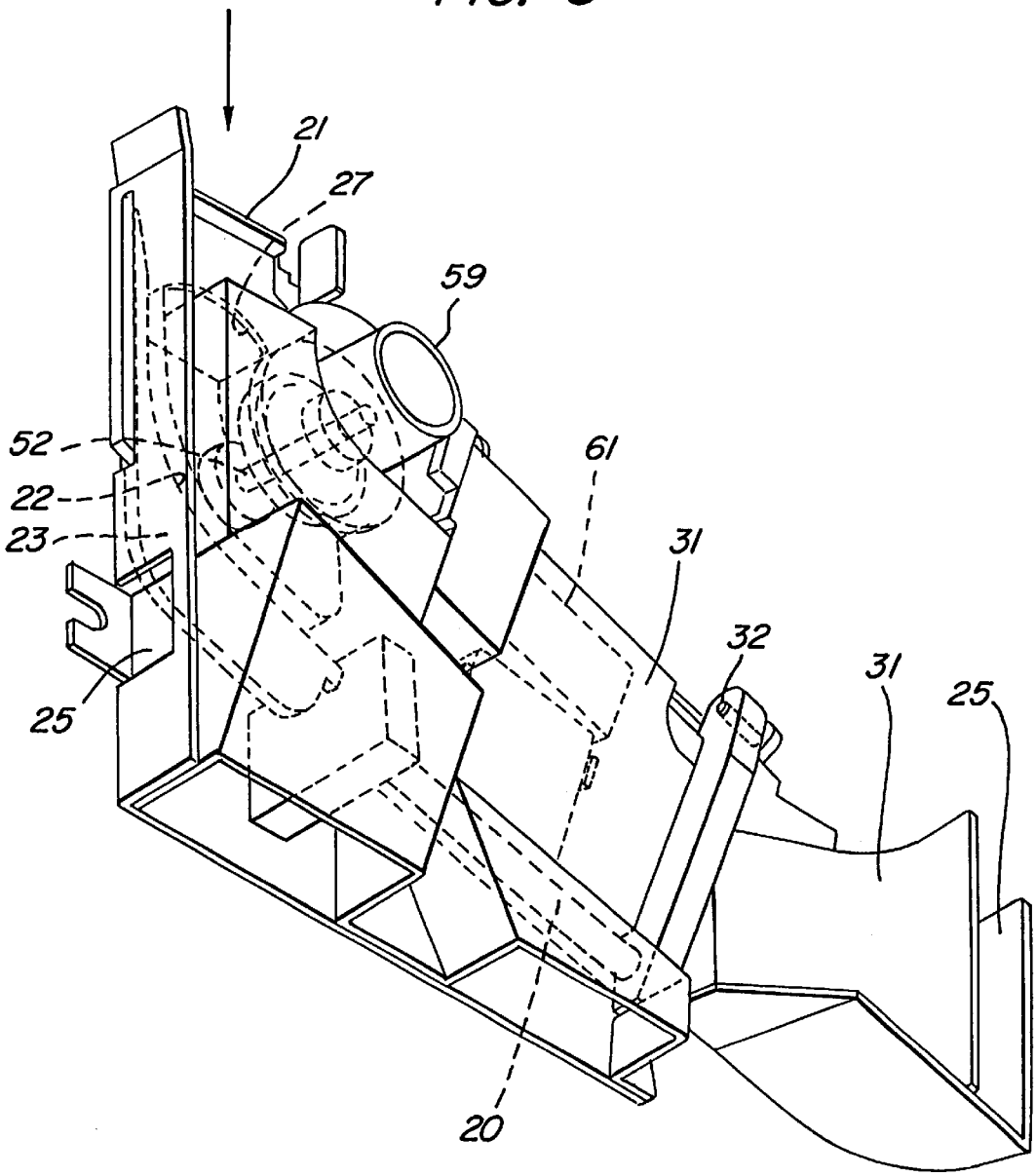
FIG. 8 is a perspective view from a lower side of a second embodiment of the present invention.
Figure 9:
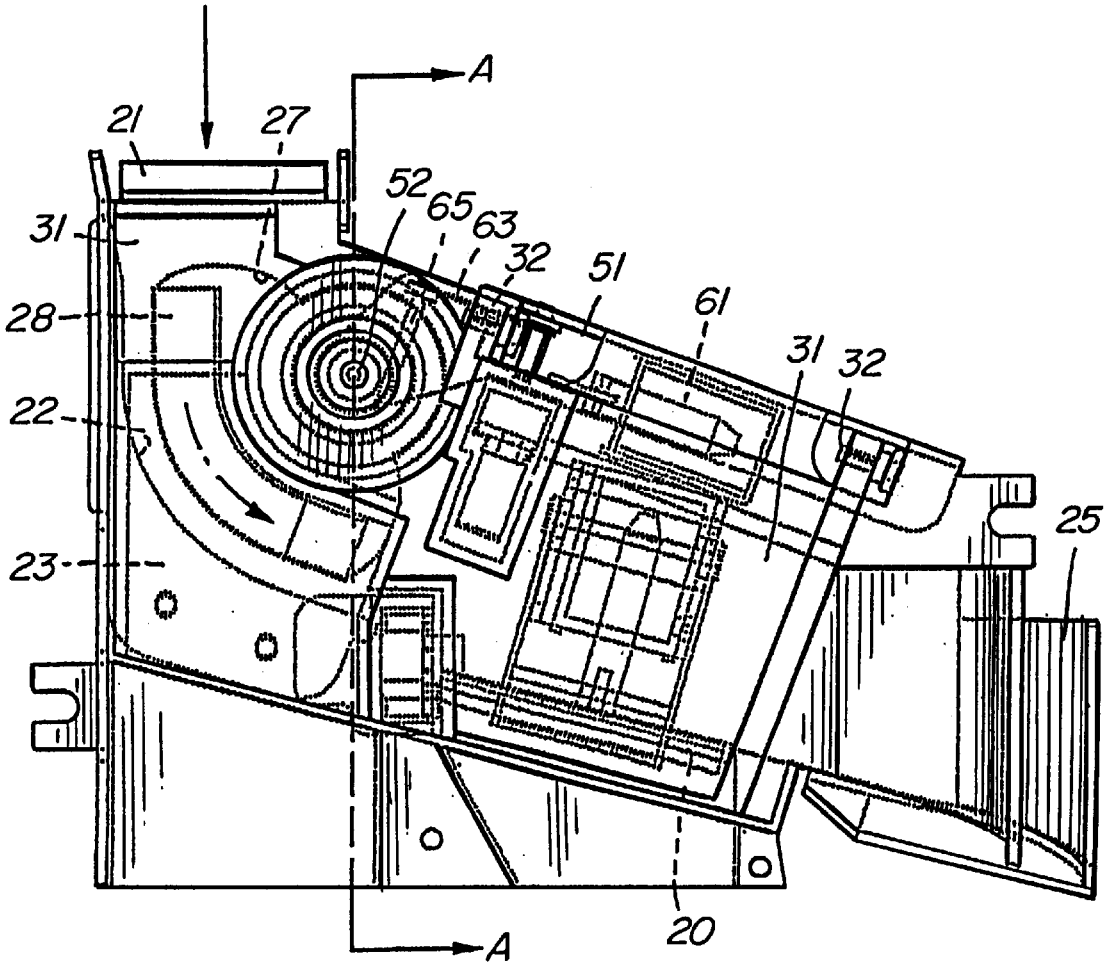
FIG. 9 is a front view of FIG. 8.
Figure 10:
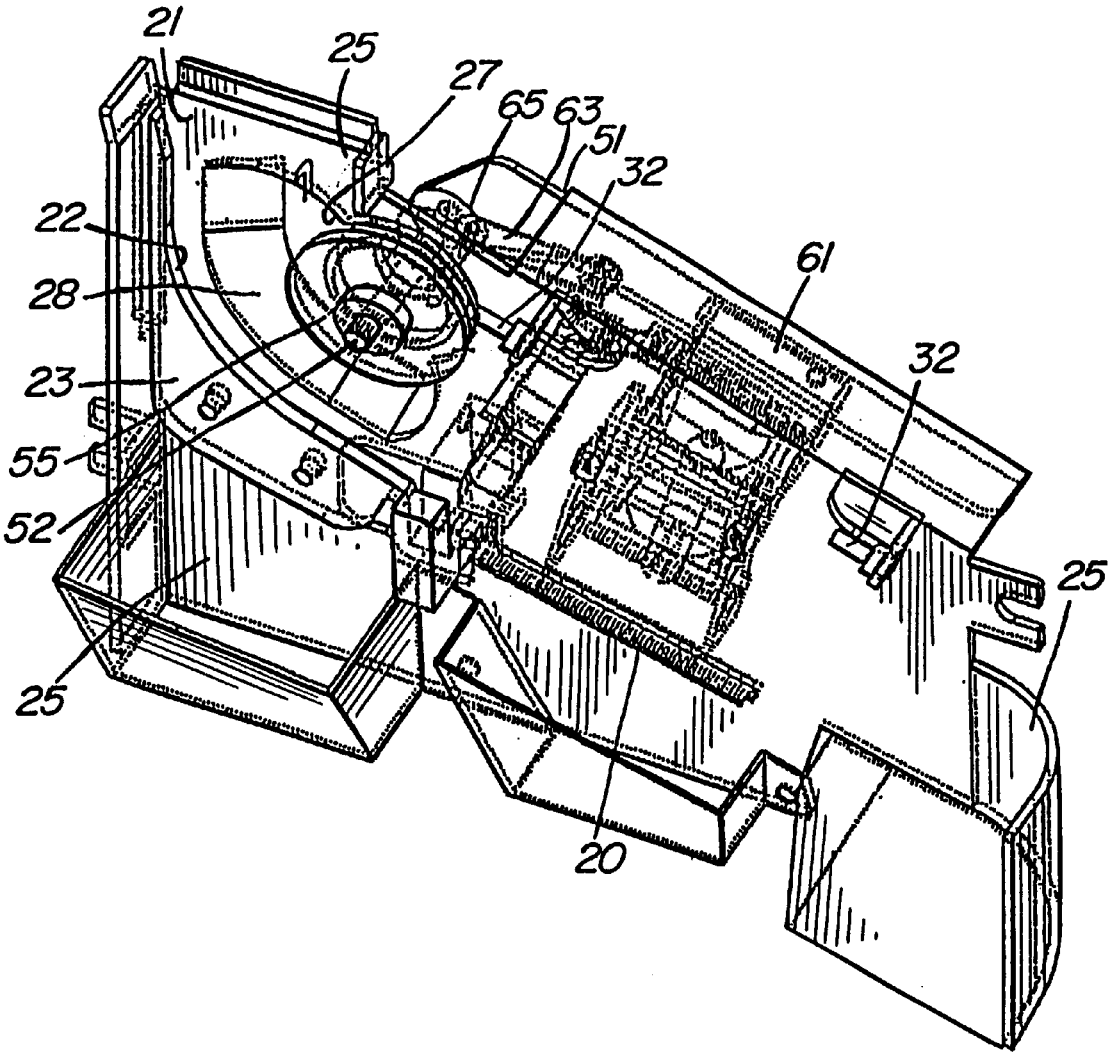
FIG. 10 is a perspective view of the second embodiment with component parts removed.
Figure 11:
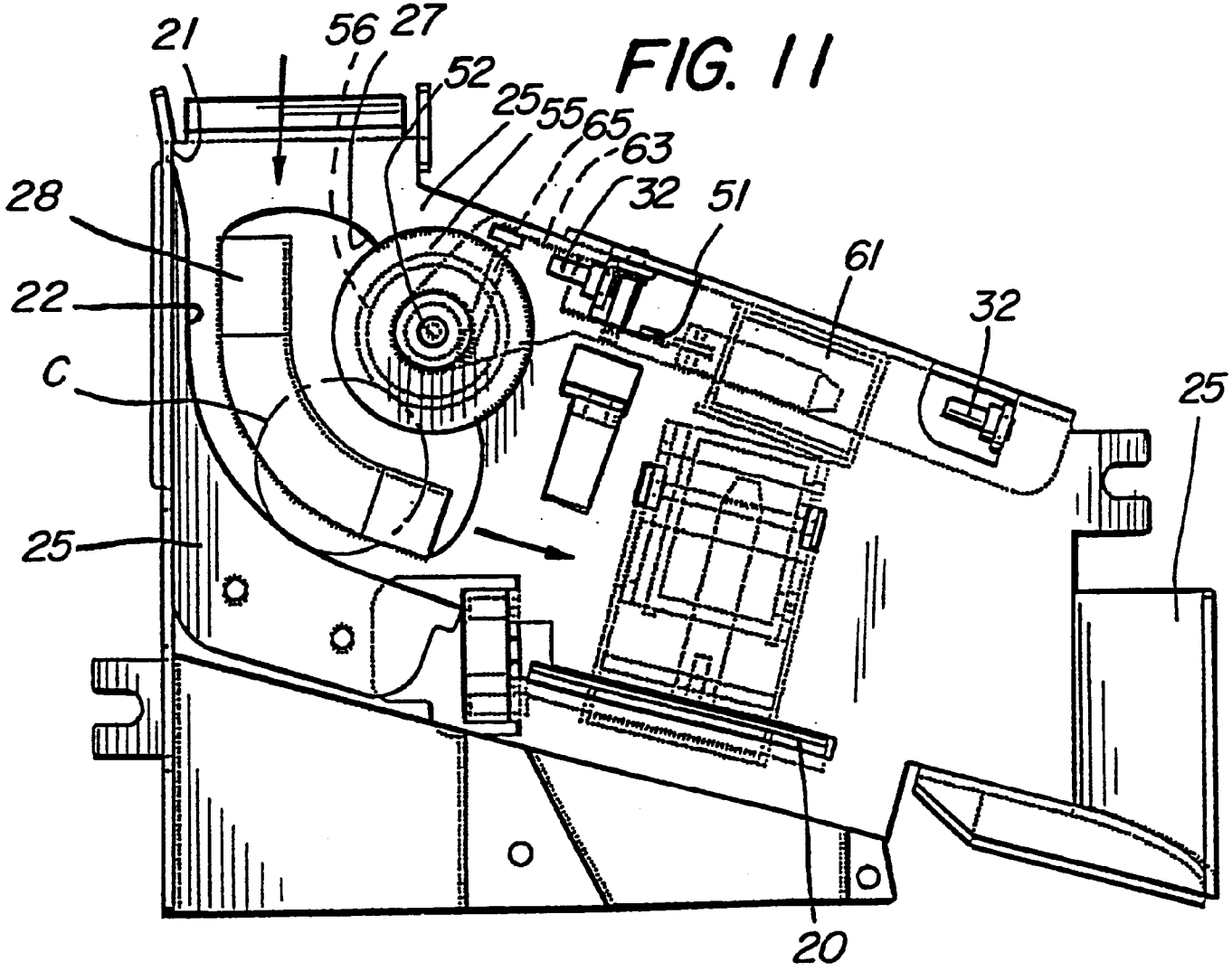
FIG. 11 is a front view of FIG. 10.
Figure 12:
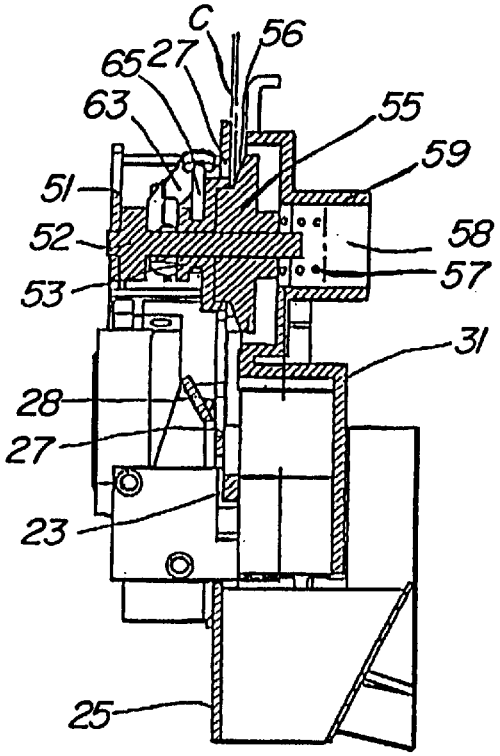
FIG. 12 is a cross-sectional view along the lines A—A shown in FIG. 9.
Figure 13:
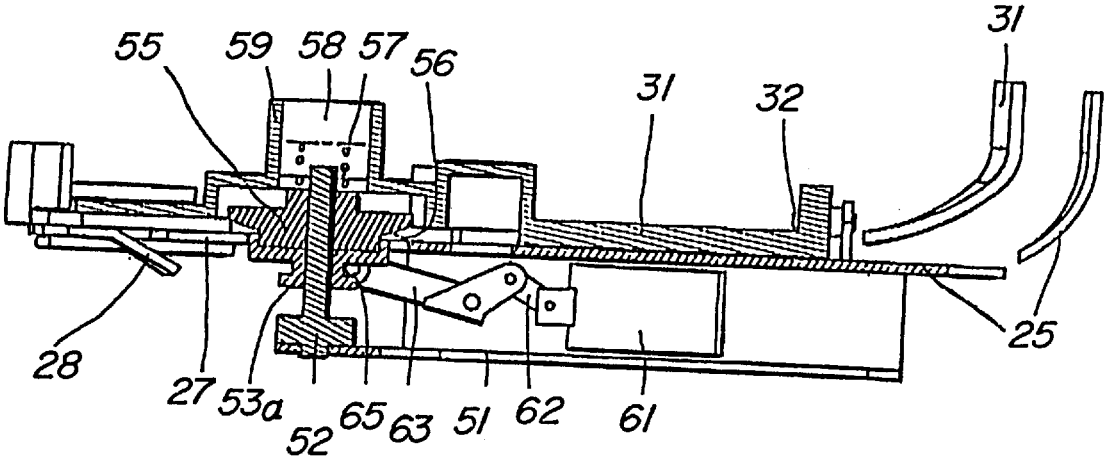
FIG. 13 is a cross-sectional view of FIG. 9.

An alternative embodiment of the present invention is disclosed and reference can be made to FIG. 8 where like reference elements are used with the same reference numbers. Again, this design of a coin selector is for a vertical mounting into an appropriate vending machine or game machine and the vertical height dimensions of the frame approximates the horizontal length dimensions. The coin is deposited through the mouth 21 and is turned at an arcuate angle along the circular passageway 22. The board member 23 is sandwiched between the main body frame 25 and the door member 31. The door member 31 is installed on the main body frame 25 by means of a pair of pivots 32 which are shown at the upper side portion of FIG. 9. On the main body frame 25 is a window or aperture 27 that is positioned near the circular arc passageway 22. A cover portion 28 is formed along its outside. An arm portion 51 is also formed along an outside that extends across approximately half of the upper portion of the main body frame 25. The arm portion 51 is further bent downward with a pivot 52 fixed at the top part. As can be seen in FIGS. 12 and 13, the pivot shaft is directed toward the door 31.

A roller unit 53 is rotatably mounted on the pivot shaft 52 and has a groove along a central portion. Additionally, on the pivot shaft 52 a roller member 55 is pivotally mounted and biased by a spring 57. The roller member 55 has a tapered surface along one side which is opposite to a second roller 53*a* with the groove. Therefore, the rollers 53*a* and 55 provide a small groove 56 of a cross-sectional V-shape between them, as shown in FIG. 13. The spring 57 is mounted on the pivot shaft 52 and is maintained in place by a plug 58 that is connected in the cylinder 59 of the door 31. As shown in FIG. 13, the solenoid 61 is mounted within the elongated rectangular body arm 51. A plunger of the solenoid 61 is connected to a small link member 62 with an oval shape that is pivotable. On the small link 61, an operating piece 63 of a long substantially L-shape is pivoted. In addition, a rod member 65 is fixed to the operating piece 63 so that the rod 65 is inserted slidably in the groove of the roller 53.

Generally, in operation, the solenoid 61 is usually on. However, when the solenoid 61 is turned off, the rod 65 is rotated around the pivot at the center of the L-shape operating rod 63. As a result, the point of the rod 65 will come apart from the roller 55. In other words, the roller 53*a* can be separated from the roller 55. Incidentally below the circular arc passageway 22, a long a rail of a roller type 20 is set in free rotation. An alternative embodiment of such a coin selector can have a small groove 56 formed as a section of cross-section V-shape established by a pair of rollers.

When a coin is thrown into an open mouth 21 in this state, the coin C is guided and turned along a circular arc passageway, as can be seen in FIG. 4 in the phantom view. If the coin C is genuine or of the selected denomination, the circular arc passageway 22 will permit the coin to pass. In this movement, the lower edge of the coin C is guided by a circular arc passageway 22 and the upper edge of the coin C is guided by the small groove 56. The upper edge of the coin C will enter into the V-shaped section between the rollers. When the coin C is true or when it is the selected coin, the coin will smoothly pass to its desired destination. Since the rotation of the pair of rollers are free, they will not provide any hindrance or obstacle for the passage of a genuine coin C. As can be appreciated, it is preferable that the spring force of spring 57 be relatively weak.

As an advantageous feature of the present invention, the rollers can be rotated by means of a small electric motor (not shown). In such a situation it is necessary that pivot 52 be formed to permit such free rotation. When the rollers are rotated, they can increase the pass-through speed of the coin C when it comes into contact with them.

If a coin that was thrown into the open mouth 21 of the coin selector is not genuine, or of the wrong monetary denomination, the diameter of such a thrown coin will be either smaller than the desired coin size or larger than the desired coin size. If the diameter of the thrown coin is smaller, then the lower edge of such a coin will be guided by the circular arc passageway 22, but the upper edge of the coin will not be guided by the small groove 56 and will not effectively contact the pair of rollers 53*a* and 55. If such a small diameter coin is thrown into the coin selector in such a manner that it vibrates, the vibration of such a coin could create a confusion that it is a true coin. For this reason, the spring 57 will help absorb such vibration. Thus, when the diameter of the coin is smaller than the desired size, the coin will come off from the pair of rollers 53*a* and 55 and will be rejected downward.

If the coin is of a diameter larger than the desired coin size, the lower edge of the coin will be guided along the circular arc passageway 22, but the upper edge of the coin will be stopped by contact with the pair of rollers 53*a* and 55. Under such circumstances, the door 31 will open and will close around the pivot center and the coin will then be discharged from the passageway 22. When the solenoid 61 is operated, the roller 53*a* will be moved and a large diameter coin will fall downward.

As can be appreciated, the desirable shape of the groove 56 is an inverted V-shape to form the arch or upper limitation of the circular arc passageway 22. Such a groove 56 could be formed as an alternative embodiment with one roller. As an additional modification, it is possible that the small groove 56 can be formed on another member, for example, a semi-circular plate. The sectional shape of the small groove 56 has one slope accurately in the present embodiment, but it is, of course, possible that two slopes can be formed.

As can be appreciated, when the coin selector is desired to be modified to change the diameter of the coin to be accepted, it is possible to do so by simply changing the roller 53*a* or 55.

The size of the entire coin selector is reduced by adopting certain simplified constructions including the use of a passageway having a partial circular arc shape. The actual diameter size of acceptable coins can be altered in an easy manner by a technician by simply changing the rollers that are used in the coin guide. Additionally, the coin selector of the present invention can be vertically installed with an appropriate position in the vending machine or arcade machine and such a coin selector can be easily adopted to adjust for various diameter size coins.

In summary, the present invention in each of its embodiments has been specifically designed to reduce the entire size of the coin selector and to permit such a coin selector to be inserted vertically within the appropriate machine. The coin selector of the present invention is user friendly in that it is easy for a service technician to change the diameter size of the coins desired to be selected. A roller or a pair of roller can be freely mounted or motor driven to provide an inverted V-shape section to guide the upper edge of a coin as the roller or rollers extend traverse to the passageway.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A coin selector assembly comprising:

a frame member having an upper entrance opening for receiving a coin and coin ejection openings;

a passageway extending into the frame member from the upper entrance opening and communicating with the ejection openings, the passageway having an arcuation entrance portion to contact a peripheral surface of the coin and change its direction through the frame member;

a roller unit with a groove for guiding an upper edge of a coin movably positioned within the passageway of the arcuation entrance portion, the frame member having vertical height dimensions that approximates a horizontal length dimension, a stopper member movably positioned within the passageway, and means for operatively positioning the roller unit within the passageway while moving the stopper member out of the passageway.

2. The coin selector assembly of claim 1, wherein the roller unit is spring biased.

3. The coin selector assembly of claim 1, wherein the roller unit includes a first and second roller member having respective edge configurations facing each other to form the groove.

4. The coin selector assembly of claim 1, wherein the roller unit includes a single roller member with an annular groove.

5. The coin selector assembly of claim 1, wherein a member having an inverted V-shape groove is positioned in the passageway to guide an upper edge of the coin.

6. The coin selector assembly of claim 5, wherein the groove is movable relative to an axis of the passageway.

7. A coin selector assembly comprising:

a frame member having an upper entrance opening for receiving a coin and coin ejection openings;

a passageway extending into the frame member from the upper entrance opening and communicating with the ejection openings, the passageway having an arcuation entrance portion to contact a peripheral surface of the coin and change its direction through the frame member;

a roller member having a groove configuration for guiding an upper edge of the coin, and means for moving the roller member traversely into and out of the passageway.

8. The coin selector assembly of claim 7, wherein the member is a roller unit having a groove aligned in the passageway with the movement of the coin.

9. The coin selector assembly of claim 8, wherein the roller unit is spring biased.

10. The coin selector assembly of claim 8 includes a motor for driving the roller unit.

11. The coin selector assembly of claim 8, wherein the roller unit includes a first and second roller member having respective edge configurations facing each other to form the groove.

12. The coin selector assembly of claim 8, wherein the roller unit includes a single roller member with an annular groove.

13. The coin selector assembly of claim 7, wherein the member with the groove is movable relative to the passageway.

14. A coin selector assembly comprising:

a frame member having an upper entrance opening for receiving a coin and coin ejection openings;

a passageway extending into the frame member from the upper entrance opening and communicating with the ejection openings, the passageway having an arcuation entrance position to contact a peripheral surface of the coin and change its direction through the frame member;

a roller unit having a groove configuration for guiding an upper edge of the coin; and a motor for driving the roller unit.

15. The coin selector assembly of claim 14 wherein the roller unit is spring biased.

16. The coin selector assembly of claim 14 wherein the roller unit includes a first and second roller member having respective edge configurations facing each other to form the groove.

17. The coin selector assembly of claim 14 further including a movable stopper member positioned within the passageway and a solenoid unit for moving the roller unit into the passageway and the stopper member out of the passageway.

18. A coin rolling type selector assembly comprising:

a frame (25) having an upper opening (21) for receiving a coin;

a passageway (22) which is shaped as approximately one quarter of a circle and extend from upper opening into the frame, for standing up and rolling a coin; and a roller unit (53) which is rotation-freely arranged substantially at the center of said circle and has a groove (56) for guiding an upper edge of said coin which is standing up and rolling.

19. The coin rolling type selector assembly of claim 18, wherein said roller unit (53) is detachably provided on said frame (25).

20. The coin rolling type selector assembly of claim 19, wherein said roller unit (53) is a resin molded product.

21. The coin selector assembly of claim 18 further including a movable stopper member positioned within the passageway and a solenoid unit for moving the roller unit and stopper member into and out of the passageway.

* * * * *